US005876481A

United States Patent [19]

Chagnon et al.

[11] Patent Number: 5,876,481

[45] Date of Patent: Mar. 2, 1999

[54] LOW ALLOY STEEL POWDERS FOR SINTERHARDENING

[75] Inventors: François Chagnon; Yves Trudel, both of Tracy, Canada

[73] Assignee: Quebec Metal Powders Limited, Quebec, Canada

[21] Appl. No.: 662,237

[22] Filed: Jun. 14, 1996

[51] Int. Cl.[6] ..... C22C 33/02

[52] U.S. Cl. ..... 75/255; 75/246; 419/38; 419/39; 419/46

[58] Field of Search ..... 75/255, 246; 419/38, 419/39, 40

[56] References Cited

U.S. PATENT DOCUMENTS

| | | | |
|---|---|---|---|
| 4,266,974 | 5/1981 | Nitta et al. | 71/251 |
| 4,382,818 | 5/1983 | Mocarski | 419/11 |
| 4,690,711 | 9/1987 | Coad | 75/244 |
| 4,696,696 | 9/1987 | Fujita et al. | 75/246 |
| 4,743,425 | 5/1988 | Ohsaki et al. | 419/16 |

FOREIGN PATENT DOCUMENTS

| | | |
|---|---|---|
| 58-130249 | 8/1983 | Japan . |

OTHER PUBLICATIONS

Salak, Ferrous Powder Metallurgy (1995) 174–176; 252–255.

*Primary Examiner*—Daniel J. Jenkins
*Attorney, Agent, or Firm*—Fitzpatrick, Cella, Harper & Scinto

[57] ABSTRACT

A steel powder consisting of a combination of purified steel and prealloyed manganese, chromium, molybdenum and nickel. The steel powder is used in the production of metal parts using powder metallurgy. The addition of the prealloyed elements results in a metal part having greater strength and hardness with a low oxygen content and good compressibility.

17 Claims, 6 Drawing Sheets

LOW ALLOY STEEL POWDERS FOR SINTERHARDENING

BACKGROUND OF THE INVENTION

1. Field of the Invention

This invention relates to alloy powders, in particular, to compositions of such powders useful for forming high hardness metal parts by powder metallurgy (P/M), and to processes for making and using such compositions.

2. Brief Description of the Background Art

Powder metallurgy is a process of imparting high pressure to highly purified, substantially uniform ferrous powders to produce ferrous parts with high densities. The process is also known as "pressure forging." Sinterhardening is a P/M process in which P/M parts transform partially or completely into martensite during the cooling phase of a sintering cycle.

In both P/M and sinterhardening, minor amounts of secondary metals are typically added to the base P/M material to improve its hardenability. In order to achieve optimum hardenability, prealloying techniques are generally preferable to elemental additions.

Manganese is added to typical commercial steels in the range of 0.25 to 1.0% to increase strength and hardenability of plain carbon steels. Chromium is also commonly added to improve hardenability, strength and wear resistance of conventional steels. However, in steel powders for use in powder metallurgy, e.g., powders having an average particle size of from 55 to 100 microns, manganese and chromium contents are generally maintained below 0.3% in order to reduce oxide formation during annealing, "Design Criteria for the Manufacturing of Low Alloy Steel Powders", *Advances in Powder Metallurgy,* vol. 5, 1991, pp. 45–58.

Molybdenum and nickel are commonly used in low alloy P/M steel powders because their oxides are easily reduced during the annealing treatment of the water-atomized powders. Molybdenum and nickel efficiently increase the strength and the hardenability of steels, while nickel also increases the strength, toughness and fatigue resistance of the steel, S. H. Avner, *Introduction to Physical Metallurgy,* McGraw-Hill, N.Y., 1974, pp. 349–361. These elements are however more expensive than manganese and chromium and are subject to large price variations which have an obvious deleterious effect on the steel powder price.

Sinterhardening is an attractive technique for the manufacturing of high hardness P/M parts because it eliminates the need for post-sintering heat treatment, thus significantly reducing processing costs. Furthermore, high thermal stresses and part distortion resulting from conventional quenching are avoided, providing improved control of final part dimensions. Previous techniques for producing low alloy steel powders for P/M application include acid treatment to remove the oxide layer in U.S. Pat. No. 3,764,295 to Höganäs and use of high carbon (0.1 to 0.70%) in the annealed powder in British Patent No. 1,564,737. In contrast, the present invention eliminates the acid treatment while maintaining oxygen and carbon at low concentrations in order to improve compressibility and minimize powder oxidation during the atomizing and annealing process. Because of these parameters, the present invention is capable of producing a steel powder with high hardenability and minimal oxygen content.

SUMMARY OF THE INVENTION

It is, therefore, an object of the present invention to overcome the drawbacks and disadvantages of the prior art, and to provide an alloy steel powder with improved hardenability to promote sinterhardening in conventional sintering furnaces.

In particular, an objective of the present invention is to produce a steel powder having a minimum apparent hardness of 30 HRC after sintering in conventional furnaces.

A further objective of the present invention is to maintain powder compressibility above 6.8 g/cm$^3$ at 40 tsi (550 MPa).

Another object of the present invention is to reduce the amount of costly prealloying elements such as molybdenum and nickel while still maintaining the hardenability of the powder.

These objects and others are attained by:

An alloy powder for powder metallurgy, said alloy powder comprising particles having particle size of 300 microns or less, preferably having an average particle size in the range of from 50 to 100 microns and comprising steel powder with at most 0.1 wt. % carbon, more preferably less than 0.02 wt. %, manganese in the range of 0.3 to 0.9 wt. %, more preferably from 0.4 to 0.7 wt. %, nickel in the range of 0.8 to 1.5 wt. %, more preferably from 1.0 to 1.2 wt. %, molybdenum in the range of 0.5 to 1.30 wt. %, more preferably from 0.85 to 1.05 wt. %, and chromium content in the range of 0.3 to 0.9 wt. %, most preferably from 0.4 to 0.7 wt. %.

Thus, by the addition of prealloyed manganese chromium, molybdenum and nickel in the prescribed amounts a steel powder having the desirable properties noted above is attained.

DETAILED DESCRIPTION OF THE PREFERRED EMBODIMENTS

The inventors have developed a new prealloy steel powder with improved hardenability to promote sinterhardening with low oxides in conventional sintering furnaces.

In order to evaluate the effect of alloying elements on sinterhardenability of different materials, a test matrix was designed to conduct comparative evaluation of various combinations of molybdenum, nickel, manganese and chromium concentrations in water-atomized steel powders. Following atomization and downstream processing, experimental steel powders were admixed with graphite, copper and lubricant, pressed to 6.8 g/cm$^3$ and sintered at 1120° C. and tempered 1 hour at 205° C. Additions of manganese and chromium were found to improve the hardenability of low alloy steel powders.

Experimental Procedure

Figure 1:
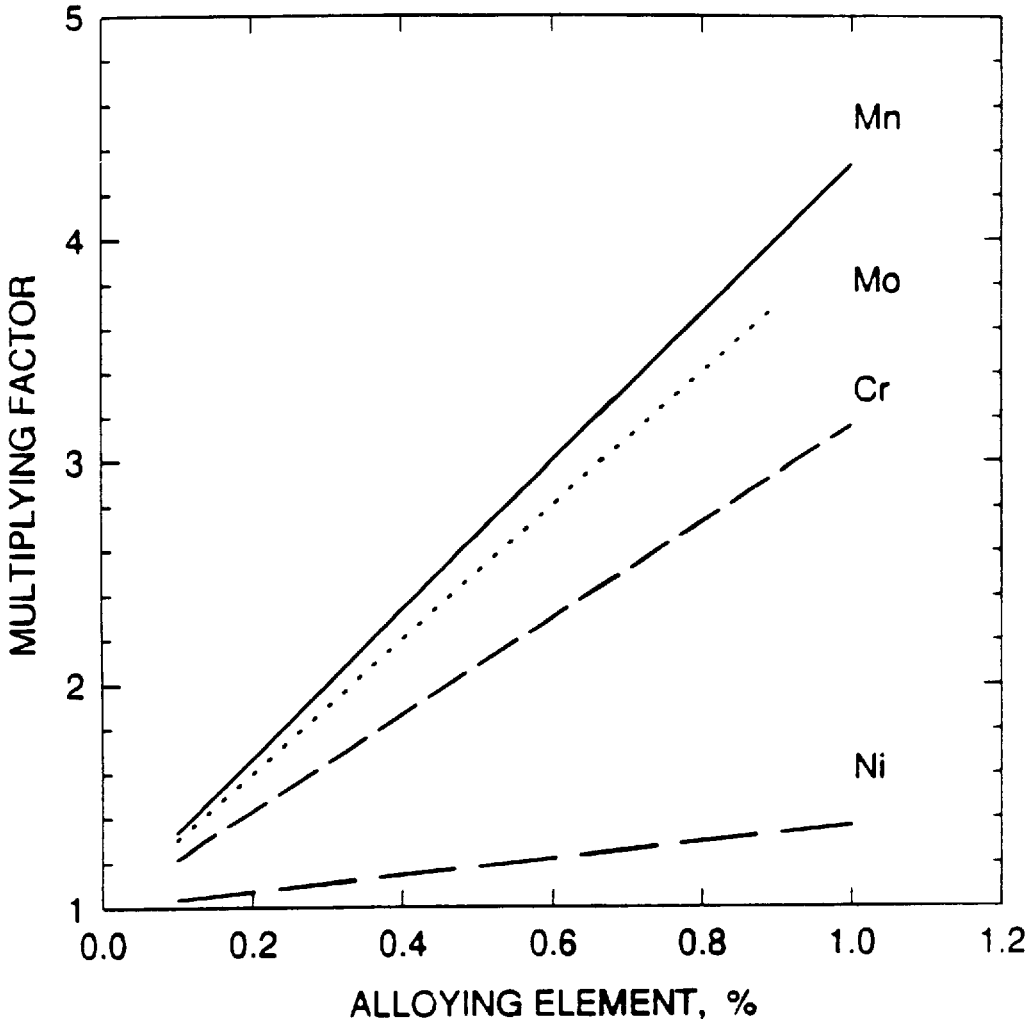
FIG. 1 illustrates the hardenability multiplying factors of the alloying elements.

Alloying elements can be used in different combinations to increase hardenability of steels. In FIG. 1, the hardenability multiplying factor, described in *The Making, Shaping and Treating of Steel,* 9th ed., United States Steel Corporation, 1971, p. 1136, is used to illustrate the effect on hardening of molybdenum, manganese, nickel and chromium concentrations. As illustrated, manganese has the most pronounced effect on hardenability followed by molybdenum, chromium and nickel.

However, as molybdenum and nickel are expensive alloying elements, the present invention substitutes a certain quantity with manganese and chromium. However, manganese and chromium oxidize during powder processing and hence deteriorate the compressibility and the sintered properties of the resulting compacts.

In order to quantify the effects of alloying elements on properties of P/M steels, a series of experimental powders were prepared using a 200 kg capacity induction furnace. High purity steel was remelted with ferromanganese, ferrochromium, ferromolybdenum and nickel to achieve the steel chemistry as shown in Table 1 below.

TABLE 1

| ID. | Mn, % | Ni, % | Mo, % | Cr, % | Hard. factor |
|---|---|---|---|---|---|
| 1 | 0.4 | 1.9 | 1.25 | 0.05 | 21.5 |
| 2 | 0.4 | 1.1 | 0.7 | 0.05 | 11.4 |
| 3 | 0.85 | 1.1 | 1.25 | 0.05 | 29 |
| 4 | 0.85 | 1.9 | 0.7 | 0.05 | 23.4 |
| 5 | 0.7 | 1 | 0.6 | 0.6 | 29.7 |
| 6 | 0.9 | 1 | 0.5 | 0.5 | 28.6 |
| 7 | 0.7 | 1 | 0.5 | 0.8 | 30.9 |
| 8 | 0.8 | 1 | 0.5 | 0.6 | 28.7 |
| 9 | 0.7 | 1 | 0.55 | 0.6 | 27.6 |
| 10 | 0.4 | 1 | 1.25 | 0.4 | 28 |
| 11 | 0.55 | 1 | 0.9 | 0.5 | 29.5 |
| 12 | 0.5 | 1.1 | 0.95 | 0.5 | 29.7 |
| 13 | 0.4 | 0.9 | 0.8 | 0.5 | 21.7 |
| 14 | 0.45 | 0.9 | 0.8 | 0.55 | 24.5 |
| 15 | 0.45 | 1.1 | 0.9 | 0.45 | 25.4 |
| Ref. (1) | 0.2 | 1.8 | 0.55 | 0.05 | 8.3 |

Ref. (1) is commercial Atomet ® 4601 powder.

After water atomization in an inert atmosphere (nitrogen), the powder alloys were dried, screened, annealed and the sintered cake was pulverized and homogenized in a blender prior to the evaluation.

The different powder alloys were analyzed for chemical composition and blended with 0.8% graphite, 2% copper and 0.75% zinc stearate (in the accompanying tables and all text, "%" and "wt. %" indicate weight percent). Test specimens were pressed in the shape of rectangular blocks to 6.8 g/cm$^3$ and sintered for 25 minutes at 1120° C. in a nitrogen/hydrogen atmosphere in a ratio of 90/10 and tempered one hour in air at 205° C. Transverse rupture strength was evaluated according MPIF standard 41 while tensile properties were determined using round machined specimens according to MPIF standard 10. Finally, impact strength was measured according to MPIF standard 41. The standards are based on Materials Standards for P/M Structural Parts, Metal Powder Industries Federation, 1994, pp. 14–15.

Additional tests were performed on four-inch diameter disc specimens weighing 450, 895 and 1345 g to evaluate the effect of the size of the specimens on the apparent hardness and the microstructure. For this part of the study, mixes containing 1.0% graphite, 2% copper and 0.75% zinc stearate were prepared from the alloys of trials 1, 3, 4 and 5 and from a commercial Atomet® 4601 powder metallurgy alloy which was used as reference. These were pressed to 6.8 g/cm$^3$, sintered 20 minutes at 1120° C. in an industrial sintering furnace using a cooling rate of either 0.75° C./s or 1.5° C./s in the range of 870° to 650° C.

Results and Discussion

The chemical, physical, green and sintered properties of the experimental alloys are shown in Table 2 below. In Table 2, the parameters C, O, S, Ni, Mo, Mn, Cr, +100 Mesh, −325 Mesh, App. Dens. and Flow refer to the alloy powder; Comp. Press. and Green Strength refer to green compacts prepared from alloy powder blended with graphite, copper and lubricant; and the balance of the parameters refer to the sintered compact.

Figure 2:
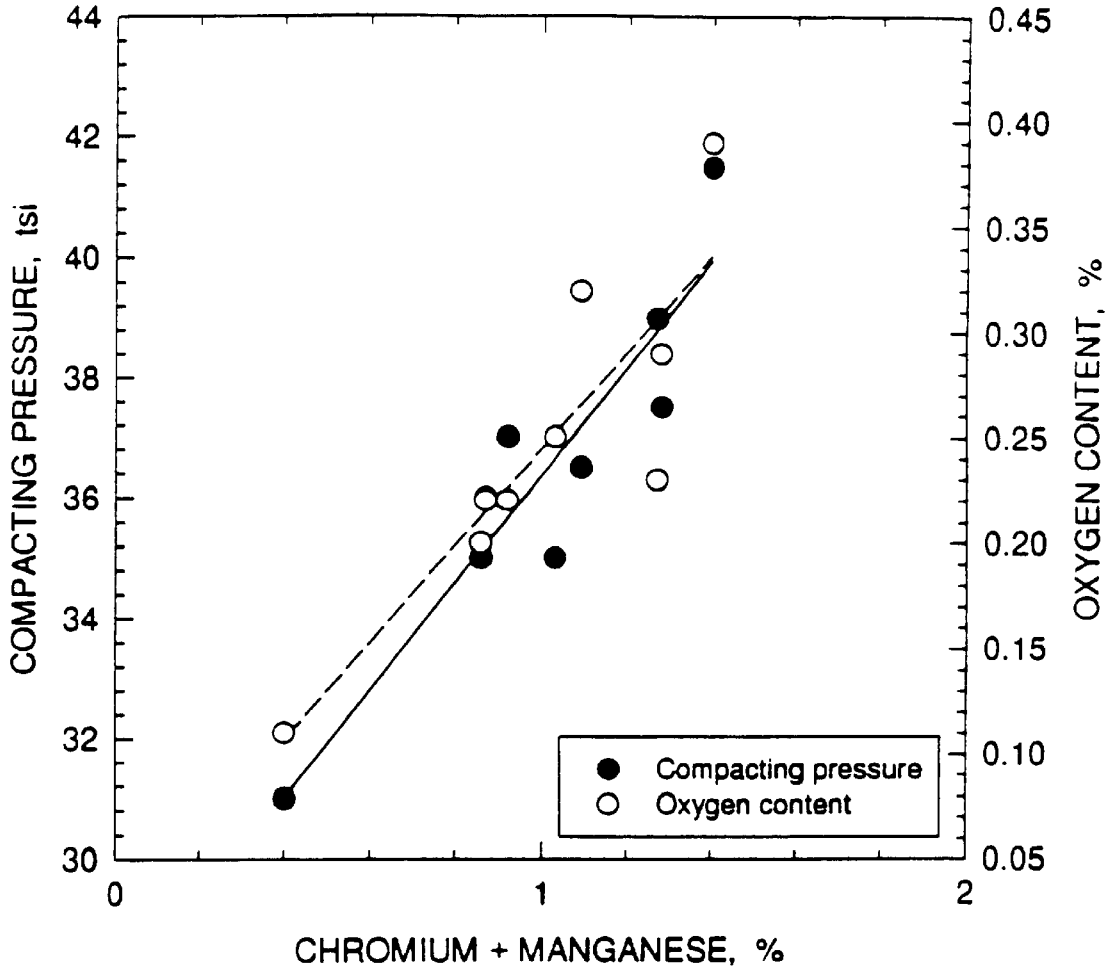
FIG. 2 illustrates the effect of manganese and chromium on compacting pressure and oxygen content of the powder.

The effect of manganese and chromium concentrations on compacting pressure and oxygen content is illustrated in FIG. 2. To eliminate the effect of the carbon content in the annealed powder on the compressibility, only the alloy with less than 0.01% carbon were taken for the analysis. It is determined that oxygen content increases linearly with the manganese and the chromium contents. The same relationship exists for the compacting pressure. To maintain oxygen content to less than 0.25%, the sum of manganese and chromium must be maintained to less than 1.0%. For these levels of manganese and chromium, compacting pressure of less than 36 tsi at 6.8 g/cm$^3$ can be achieved. This compressibility result is even better than that of commercial Atomet® 4601 powder which has a significantly lower hardenability factor than the experimental powder, 8.3 versus more than 20 for the experimental powders.

Figure 3:
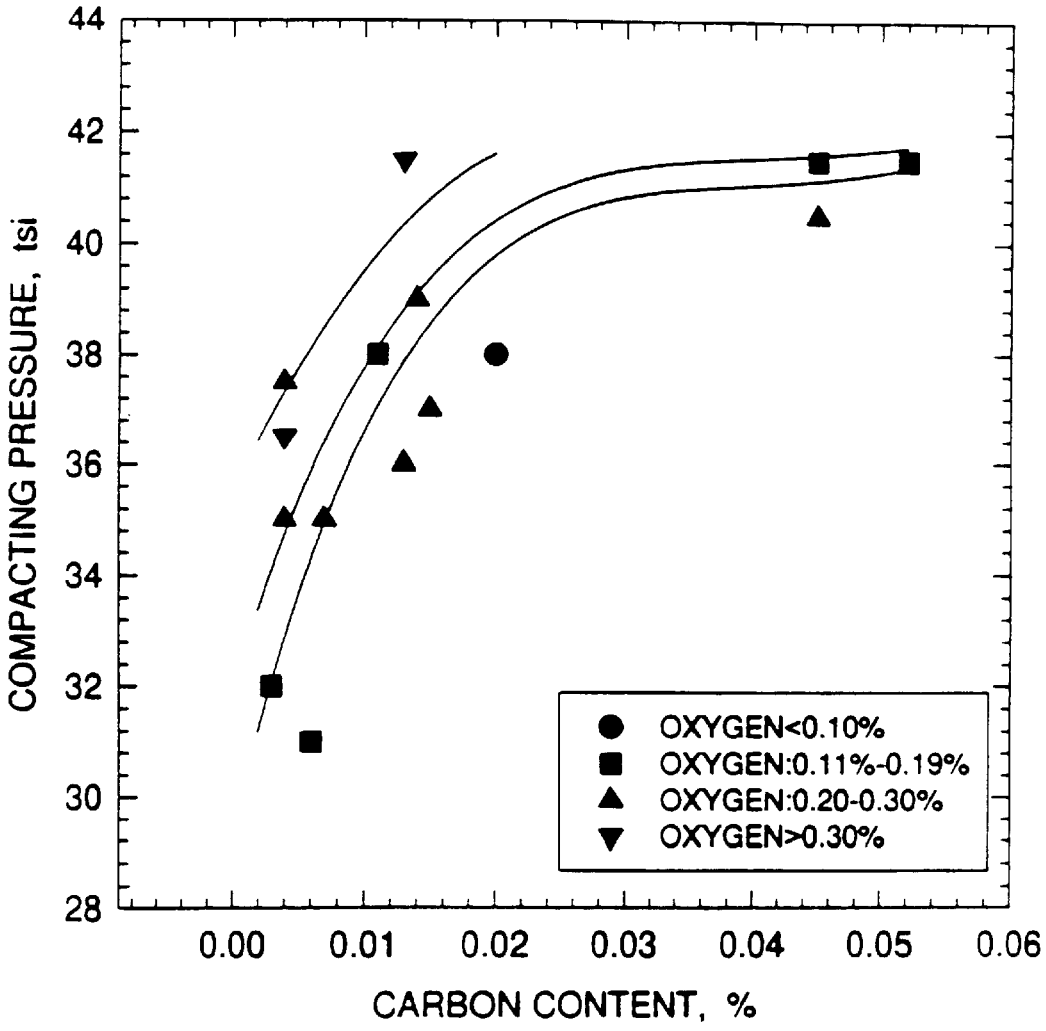
FIG. 3 illustrates the effect of oxygen and carbon contents on compacting pressure.

FIG. 3 illustrates the effect of carbon and oxygen concentrations in the annealed powder of the experimental powders. The compacting pressure increases with the carbon and oxygen contents of the annealed powders. To reduce the compacting pressure at low levels, less than 36 tsi, carbon content must be maintained to less than 0.02%. Also, oxygen content has to be minimized to optimize the compressibility. However, since the reduction of oxygen during the annealing of the steel powder is controlled by the quantity of carbon in the furnace feed, a too low amount of carbon will not allow to reduce the oxides and this will result in a high oxygen content in the annealed powder and hence to a deterioration of the compressibility. On the other hand, a too high amount of carbon in the annealed powder will result in a lower oxygen content but this higher carbon content will also deteriorate the compressibility. Hence, both elements must be adjusted to allow the reduction of the oxygen while maintaining carbon content in the annealed powder to less than 0.02%.

Figure 4:
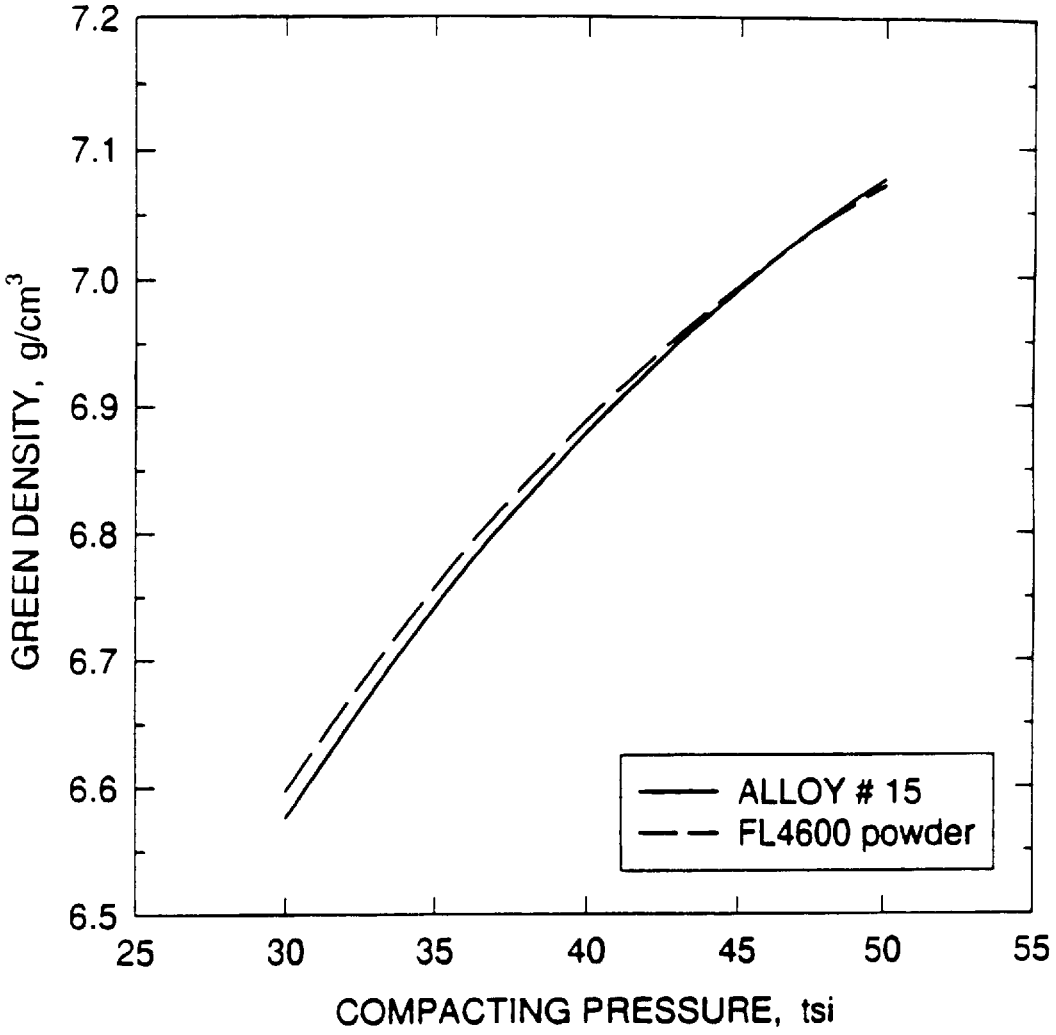
FIG. 4 illustrates the variation of green density with the compacting pressure.

As illustrated in FIG. 4, by maintaining carbon content to less than 0.02% and oxygen content to less than 0.25%, the new low alloy steel exhibits a compressibility similar to commercial Atomet® 4601 powder with however a significantly higher hardenability.

Figure 5:
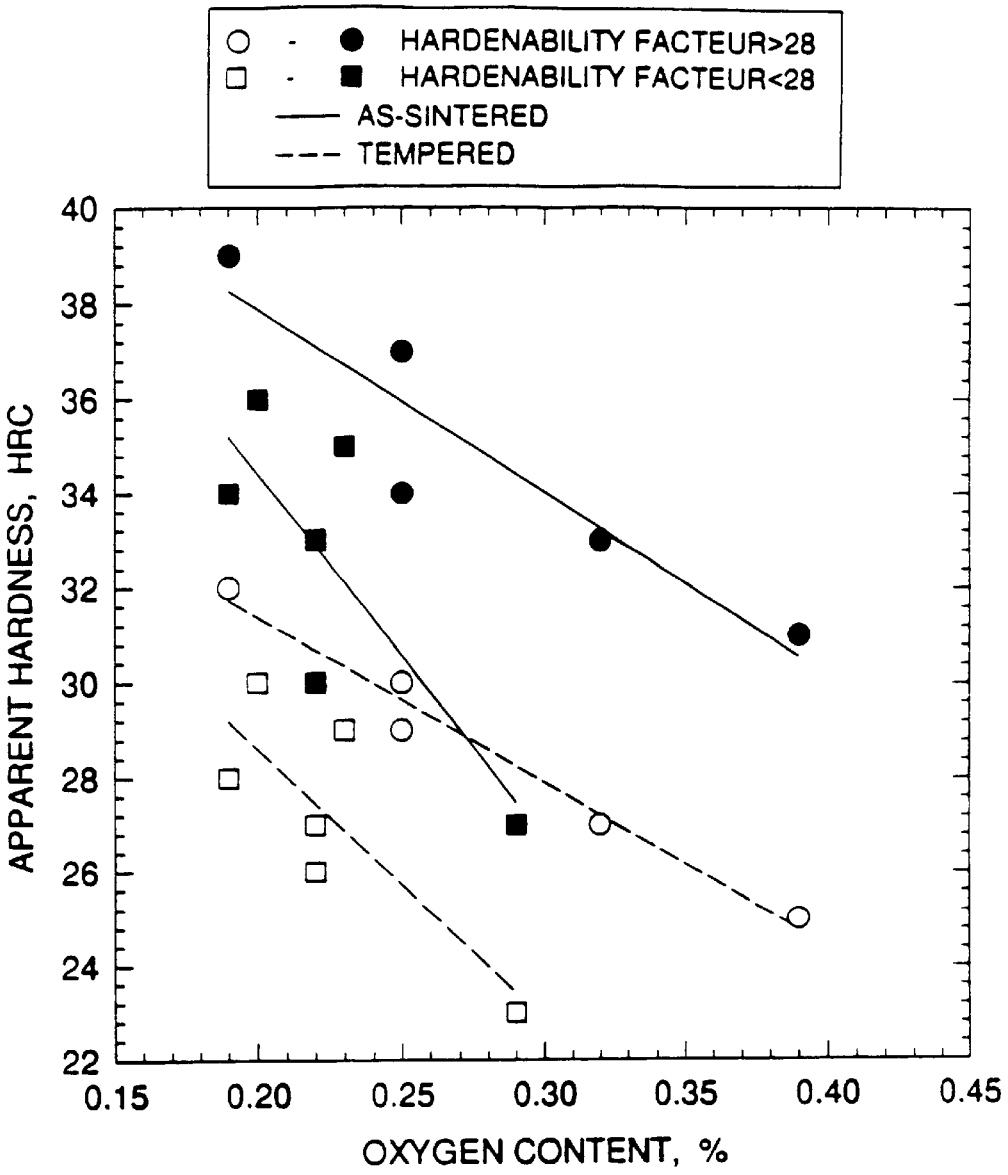
FIG. 5 illustrates oxygen content of annealed powder on apparent hardness of as-sintered and as-tempered specimens.

The effect of oxygen content on apparent hardness after sintering and after tempering is illustrated in FIG. 5 for alloys with different hardenability factors. Apparent hardness decreases with the oxygen content and the rate of reduction is more pronounced for alloys with lower hardenability factors. This is related to the reaction of a portion of the graphite present in the specimen with the oxygen in the powder. The reduction of oxygen by carbon results in a lower carbon content in the sintered specimens. This loss of carbon affects the alloy hardenability and this effect is more pronounced in alloys with lower hardenability. Hence, to optimize the hardenability of the powder steel, oxygen content of the annealed powder has to be minimized. As previously mentioned, low oxygen contents are assured by proper control of the carbon content in the powder before annealing.

Figure 6:
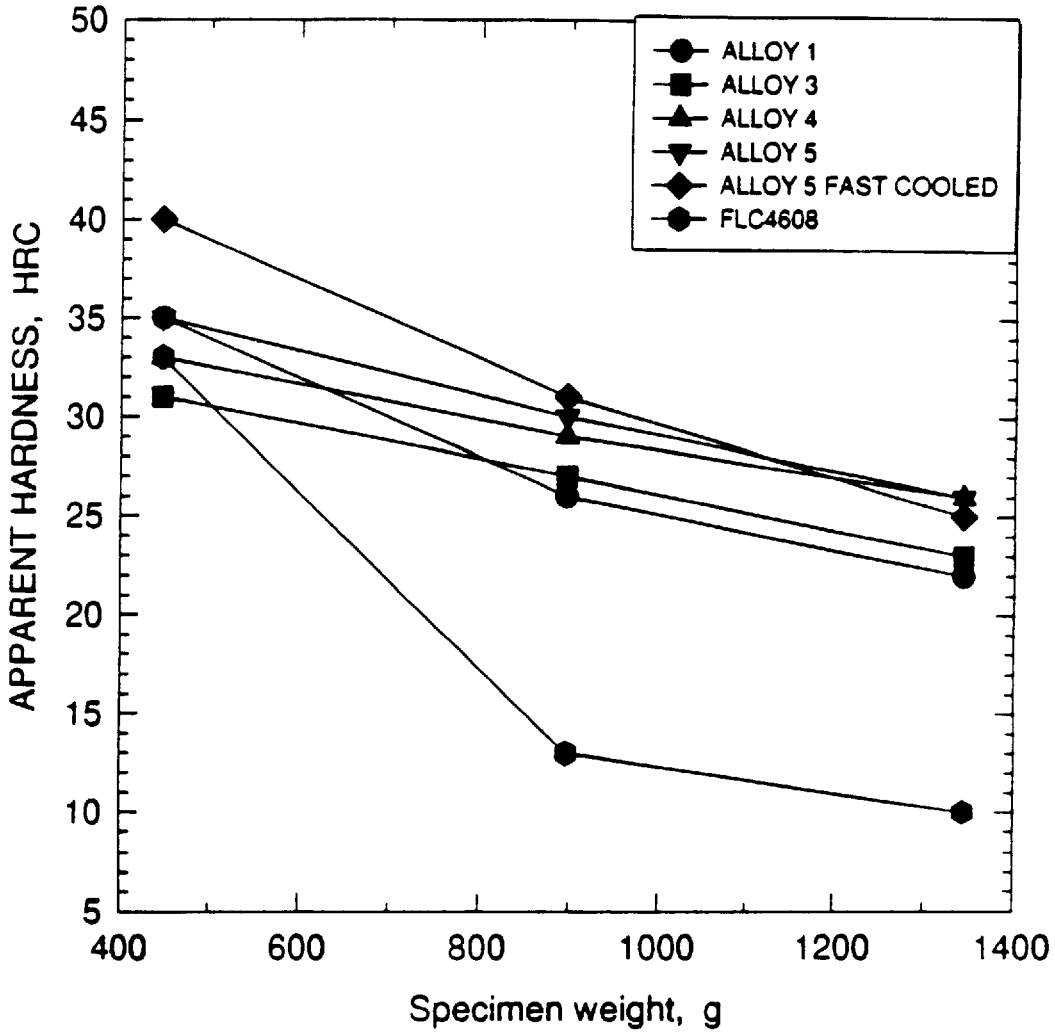
FIG. 6 illustrates the effect of specimen weight on apparent hardness.

FIG. 6 illustrates the effect of the specimen weight on apparent hardness after sintering measured on the cross section of disc specimens made of alloys #1, 3, 4, 5, 5 fast cooled and for a commercial FLC4608 alloy. The hardenability factor of these alloys were respectively 22, 29, 23, 30 and 8. It can be observed that for the 450 g specimens, alloys sintered without fast cooling rate respond in a similar way to sinterhardening with apparent hardness values in the range of 31 to 35 HRC. However, as the specimen weight reaches 895 g, the apparent hardness of the FLC4608 specimen drops sharply to values in the range of 10 to 15 HRC which are almost half of that of the experimental powders. For these latter, apparent hardness decreases linearly with the specimen weight by about 1 HRC for each 100 g increment of the specimen weight. It is also worth noting that the alloy #5 fast cooled showed the highest apparent hardness for the 450 g specimen but the difference is reduced as the weight of the specimens reaches 895 g.

To maintain high apparent hardness on heavy parts, the hardenability factor must be maintained to values at least of 22. However, to obtain a good alloy robustness to carbon content in the sintered parts, a hardenability factor of more than preferably 25 is recommended while maintaining oxygen content to less than 0.25%.

TABLE 2

| | 1 | 2 | 3 | 4 | 5 | 6 | 7 | 8 | 9 | 10 | 11 | 12 | 13 | 14 | 15 | Atomet ® 4601 |
|---|---|---|---|---|---|---|---|---|---|---|---|---|---|---|---|---|
| C, % | 0.020 | 0.006 | 0.045 | 0.011 | 0.052 | 0.004 | 0.045 | 0.013 | 0.014 | 0.003 | 0.004 | 0.004 | 0.013 | 0.015 | 0.007 | 0.005 |
| O, % | 0.08 | 0.11 | 0.17 | 0.19 | 0.19 | 0.29 | 0.25 | 0.39 | 0.23 | 0.19 | 0.25 | 0.32 | 0.22 | 0.22 | 0.20 | 0.10 |
| S, % | 0.007 | 0.006 | 0.007 | 0.006 | 0.006 | 0.005 | 0.005 | 0.005 | 0.005 | 0.004 | 0.004 | 0.004 | 0.007 | 0.007 | 0.006 | 0.007 |
| Ni, % | 1.90 | 1.22 | 1.12 | 1.96 | 1.08 | 0.97 | 0.98 | 1.03 | 1.03 | 1.01 | 1.03 | 1.11 | 0.90 | 0.91 | 1.10 | 1.80 |
| Mo, % | 1.32 | 0.68 | 1.23 | 0.76 | 0.59 | 0.45 | 0.45 | 0.49 | 0.52 | 1.24 | 0.92 | 0.93 | 0.82 | 0.83 | 0.92 | 0.55 |
| Mn, % | 0.40 | 0.40 | 0.86 | 0.87 | 0.74 | 0.93 | 0.67 | 0.80 | 0.70 | 0.37 | 0.53 | 0.50 | 0.40 | 0.43 | 0.42 | 0.20 |
| Cr, % | 0.04 | 0.04 | 0.05 | 0.05 | 0.62 | 0.35 | 0.91 | 0.60 | 0.57 | 0.40 | 0.50 | 0.59 | 0.47 | 0.49 | 0.44 | 0.05 |
| +100 Mesh, % | 15.2 | 12.2 | 12.4 | 10.4 | 11.0 | 12.1 | 12.4 | 10.1 | 15.8 | 12.5 | 9.7 | 11.0 | 9.6 | 11.2 | 11.7 | 10.0 |
| −325 Mesh, % | 11.3 | 15.1 | 16.4 | 15.7 | 16.8 | 17.4 | 14.3 | 20.7 | 11.9 | 14.9 | 20.4 | 17.0 | 19.9 | 17.1 | 15.3 | 22.0 |
| App. Dens. g/cm$^3$ | 2.88 | 2.87 | 2.88 | 2.88 | 2.92 | 3.05 | 2.83 | 3.13 | 3.02 | 3.09 | 3.02 | 2.90 | 2.91 | 3.00 | 2.92 | 2.92 |
| Flow, s/50 g | 28 | 28 | 29 | 29 | 28 | 26 | 29 | 27 | 27 | 25 | 26 | 28 | 28 | 27 | 28 | 27 |
| Comp. Press., tsi at 6.8 g/cm$^3$ | 38.0 | 31.0 | 41.5 | 38.0 | 41.5 | 37.5 | 40.5 | 41.5 | 39.0 | 32.0 | 35.0 | 36.5 | 36.0 | 37.0 | 35.0 | 37.0 |
| Green Strength, psi | 1610 | 1155 | 1845 | 1535 | 1915 | 1105 | 1935 | 1225 | 1620 | 885 | 1310 | 1335 | 1555 | 1600 | 1265 | 1540 |
| Dim. Ch., % | 0.15 | 0.28 | 0.04 | 0.27 | 0.09 | 0.38 | 0.13 | 0.58 | 0.29 | 0.14 | 0.14 | 0.18 | 0.14 | 0.14 | 0.17 | 0.28 |
| Hardness, HRC (as-sint.) | 40 | 33 | 41 | 37 | 39 | 27 | 37 | n.d. | 35 | 34 | 34 | 33 | 30 | 33 | 36 | 33 |
| Hardness, HRC (after temp.) | 33 | 27 | 33 | 30 | 32 | 23 | 30 | 25 | 29 | 28 | 29 | 27 | 26 | 27 | 30 | 28 |
| TRS, kpsi | 211.5 | 206.4 | 169.0 | 187.6 | 227.5 | 198.5 | 232.6 | 132.6 | 213.1 | 204.9 | 229.2 | 232.5 | 235.1 | 229.2 | 233.4 | 210.0 |
| UTS, kpsi | 127.4 | 102.8 | 120.3 | 104.9 | 130.8 | 90.0 | 120.0 | | | 128.9 | | | | | 117.1 | |
| YS, kpsi | 103.9 | 83.1 | 109.4 | 92.1 | 103.6 | 78.4 | 97.7 | | | 109.7 | | | | | 92.5 | |
| Elongation, % | 0.5 | 0.7 | 0.3 | 0.4 | 0.5 | 0.3 | 0.4 | | | 0.6 | | | | | 0.6 | |
| Impact Strength, ft-lb | 9.1 | 6.0 | 8.6 | 7.0 | 10.0 | 6.4 | 10.2 | | | 11.9 | | | | | 10.8 | |

Mix formulation: 2% copper + 0.8% graphite + 0.75% zinc stearate
Sintering: 25 minutes at 1120° C. in nitrogen base atmosphere
Tempering: 60 minutes in air at 205° C.

In particular, these results are obtained by maintaining the content of both manganese and chromium in the range of 0.4 to 0.7 wt. %, nickel content in the range of 1.0 to 1.2 wt. % (preferably for a Ni/Cr ratio of 1.35:1–2.65:1), molybdenum in the range of 0.85 to 1.05 wt. % in order to reduce the oxygen content below 0.25 wt. % and hardness, strength, impact resistance while fixing nickel content at 1.05 to 1.25 wt. %, preferably to maintain a hardenability factor of more than 25. To maintain optimum compressibility, the carbon and oxygen contents of powder are desirably maintained to less than 0.02 and 0.25%, respectively.

Although the present invention was illustrated with reference to certain preferred embodiments, it will be appreciated that the present invention is not limited to the specifics set forth therein. Those skilled in the art will readily appreciate numerous variations and modifications within the spirit and scope of the present invention, and all such variations and modifications are intended to be covered by the present invention which is defined by the following claims.

What is claimed is:

1. A prealloyed ferrous powder comprising iron and at least one alloying material selected from the group consisting of carbon, chromium and manganese, wherein said carbon is contained in an amount of at most 0.1 wt. %, and said chromium and manganese are contained in a total amount of at least 0.7 wt. %, said ferrous powder having a particle size of at most 300 microns and an oxygen content of at most 0.3 wt. %.

2. The alloy powder of claim 1 wherein said alloy is a steel alloy and said carbon is contained in an amount of at most 0.02 wt. %.

3. The alloy powder of claim 1 wherein the alloy contains manganese in the range of 0.3 to 0.9 wt. %, chromium in the range of 0.3 to 0.9 wt. %, nickel in the range of 0.8 to 1.5 wt. % and molybdenum in the range of 0.5 to 1.30 wt. %, said alloy having an average particle size of from 50 to 100 microns and being produced by water atomization without acid treatment.

4. The alloy powder of claim 3 wherein said alloy is a steel alloy and said carbon is contained in an amount of at most 0.02 wt. %.

5. The alloy powder of claim 4 wherein the alloy contains manganese in the range of 0.4 to 0.7 wt. %, chromium in the range of 0.4 to 0.7 wt. %, nickel in the range of 0.8 to 1.2 wt. % and molybdenum in the range of 0.90 to 1.25 wt. %.

6. The alloy powder of claim 5, wherein the alloy contains nickel in the range of 0.8 to 1.0 wt. %.

7. The alloy powder according to any of claims 1–5 or 6, wherein the amount of manganese, chromium, molybdenum and nickel in the range of 2.65 to 3.65 total wt. %.

8. The alloy powder of claim 4 having a hardenability factor of at least 22.

9. The alloy powder of claim 7, having a Ni:Cr weight ratio in the range of 1.5:1 to 2.65:1.

10. A powder blend according to any of claims 1–5 or 6, further comprising lubricant and at least one of copper or graphite.

11. A powder blend according to claim 7, further comprising lubricant and at least one of copper or graphite.

12. The powder blend according to claim 8, which achieves a component having a compressibility such that a density of at least 6.8 g/cm$^3$ is reached at a pressure of at most 40 tsi.

13. The alloy powder according to claim 9, which is produced by water atomization under an inert atmosphere.

14. A powder metallurgy process, comprising the steps of:

selecting a prealloyed ferrous powder according to claim 10; and compressing said ferrous powder at a pressure of at least 20 tsi to produce a compact; and sintering said compact.

15. A powder metallurgy process, comprising the steps of:

selecting a prealloyed ferrous powder according to claim 11; and compressing said ferrous powder at a pressure of at least 20 tsi to produce a compact; and sintering said compact.

16. The process according to claim 14 wherein said compact is sintered at a temperature of at least 1120° C.

17. The process according to claim 15, wherein said compact is sintered at a temperature of at least 1120° C.

* * * * *

UNITED STATES PATENT AND TRADEMARK OFFICE

CERTIFICATE OF CORRECTION

PATENT NO. : 5,876,481

DATED : March 2, 1999

INVENTOR(S) : FRANÇOIS CHAGNON ET AL.

It is certified that error appears in the above-identified patent and that said Letters Patent is hereby corrected as shown below:

In the drawings

SHEET 5

"FACTEUR>28" should read --FACTOR>28--;
"FACTEUR<28" should read --FACTOR<28--.

COLUMN 6

Line 54, "claims 1-5 or 6," should read --claims 1-6,--;
Line 57, "in" should read --is in--;
Line 62, "claims 1-5 or 6," should read claims 1-6,--.

Signed and Sealed this

Fourth Day of July, 2000

*Attest:*

*Attesting Officer*

Q. TODD DICKINSON

*Director of Patents and Trademarks*